US011369192B2

(12) United States Patent
Grabowski et al.

(10) Patent No.: US 11,369,192 B2
(45) Date of Patent: Jun. 28, 2022

(54) FLOATING TABLE LEG CAP

(71) Applicants: Daniel Grabowski, East Grand Rapids, MI (US); Michael Johnson, West Olive, MI (US); Peter LaDuke, Holland, MI (US)

(72) Inventors: Daniel Grabowski, East Grand Rapids, MI (US); Michael Johnson, West Olive, MI (US); Peter LaDuke, Holland, MI (US)

( * ) Notice: Subject to any disclaimer, the term of this patent is extended or adjusted under 35 U.S.C. 154(b) by 0 days.

(21) Appl. No.: 16/860,390

(22) Filed: Apr. 28, 2020

(65) Prior Publication Data

US 2021/0330071 A1 Oct. 28, 2021

(51) Int. Cl.
*A47B 13/02* (2006.01)

(52) U.S. Cl.
CPC ..... *A47B 13/021* (2013.01)

(58) Field of Classification Search
CPC ..... A47B 13/021; A47B 13/003; A47B 2013/022; A47B 2013/066
See application file for complete search history.

(56) References Cited

U.S. PATENT DOCUMENTS

| | | | | |
|---|---|---|---|---|
| 2,852,221 | A * | 9/1958 | Steiner | F16B 12/52 248/188 |
| 2,942,923 | A * | 6/1960 | Herrmann | F16B 12/48 248/188 |
| 3,267,888 | A * | 8/1966 | Carlson | F16B 9/052 108/158 |
| 3,379,398 | A * | 4/1968 | Boccone | A47B 13/021 248/188 |
| 5,934,203 | A * | 8/1999 | Glass | A47B 87/002 108/156 |
| 2015/0351537 | A1* | 12/2015 | Grabowski | A47B 87/002 108/64 |
| 2017/0108022 | A1* | 4/2017 | Gregory | F16B 12/44 |
| 2020/0170405 | A1* | 6/2020 | Grabowski | A47B 13/003 |

* cited by examiner

*Primary Examiner* — Daniel J Rohrhoff
(74) *Attorney, Agent, or Firm* — Gutwein Law; Greg N. Geiser

(57) ABSTRACT

A floating tabletop leg cap configured for movable receipt onto the connecting portion of supporting member for positioning adjacent to an end portion of a table leg receiving the connecting portion. The floating tabletop leg cap including a resilient member affixed in a coupling between the supporting member and floating tabletop leg cap. Preferably, the resilient member is a compression spring configured to bias in a direction along a length of the table leg.

7 Claims, 4 Drawing Sheets

FLOATING TABLE LEG CAP

CROSS-REFERENCE TO RELATED APPLICATION

Not Applicable

FEDERALLY SPONSORED RESEARCH OR DEVELOPMENT

Not Applicable

SEQUENCE LISTING, A TABLE, OR A COMPUTER PROGRAM

Not Applicable

FIELD OF THE INVENTION

This invention relates generally to modular table and desking systems. More specifically, the present invention is directed to modular table and desking systems, and in particular a cap assembly for movable receipt adjacent to a table leg.

BACKGROUND

Tables and desking systems come in countless forms and are utilized by everyone for eating, meeting with others, working, studying and other activities. Tables and desking systems are typically designed for assembly at their final destination, with the legs detached from the tabletop for more economical and convenient shipment. However, the tabletop must then be attached to the legs or a table frame by the end user or a professional installer. Further, a user may desire to disassemble the table for storage or movement, or to reconfigure a configurable desking system.

To address these challenges, many methods, systems and components have been developed for attaching the tabletop to the table legs, or to a table frame. Preferably, these methods and systems allow for the tabletop to be easily detached from the table legs, or the table frame, so that the table may be disassembled for storage or movement, and later reassembled.

One such assembly method utilizes a generally tubular member forming a leg with a shaped cavity configured at one end for the receipt of corner supports and cross members for supporting the tabletop. Typically, these cross members or corner supports are provided in a corresponding shape specifically configured for receipt into the cavity of the leg, wherein the leg is press fit into the corner support or cross member during assembly for a robust connection. Preferably, both the supports, the cross members, and the legs are provided in a metal material for strength and durability.

Generally, in the manufacture and assembly of commercial tables and desking systems that utilize cooperative parts in a mated assembly there exist several problems. Due to manufacturing tolerances and material variation, manufacturers are in a near continual struggle to configure metal pieces that fit together against one another in a secure and robust assembly. This is particularly difficult under specific conditions, such as a change of temperature, wherein the various metal pieces tend to contract and expand loosening joints and causing the tabletop assembly to wobble and shift.

Because of these manufacturing tolerances and variations in material, there exists a need within the marketplace for additional improvements related to securing cooperating table legs and support members together. Preferably, these needs provide a solution that absorbs and compensates for the differences in manufacturing tolerances, temperature expansion/contraction, and is particularly adapted for use in secure cooperating pieces constructed of substantially metal materials.

BRIEF SUMMARY OF THE INVENTION

The present disclosure is most generally related to a resiliently movable cap member for placement on a table leg to aid in the securing and fitment of the table into a supporting member of a tabletop.

In another aspect this present disclosure is related to a cap member that provides an improved aesthetic to a table leg assembly within a tabletop supporting member that provides an assembly without a visible gap between the connection of the table leg and supporting member through a resilient assembly that holds the cap member in adjacency against a table leg.

The floating table leg cap of the present disclosure comprises a planar member having a shape corresponding to the shape of a table leg that is movable received within a tabletop supporting member. The floating table leg cap movable receipt within the tabletop supporting member is generally facilitated through the use of a resilient member in a fastened coupling between the cap and supporting member.

In the preferred assembly of the present disclosure, the floating table leg cap includes a means configured to receive a pair of fasteners surrounded by a resilient member, such as, but not limited to, a spring member though a pair of corresponding apertures in the supporting member. Accordingly, the floating table leg cap is capable of biasing in an adjacent direction against an installed leg member within the supporting member. Through the tension of the resilient members the leg cap is movable relative to the connection to cover and secure the leg end portion despite temperature changes and material tolerance issues and interactions.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

BRIEF DESCRIPTION OF THE DRAWING(S)

In the drawings, which are not necessarily drawn to scale, the numerals may describe components in different views. The drawings illustrate, generally, by way of example, but not by way of limitation, various examples and embodiments discussed in the present document.

DETAILED DESCRIPTION OF THE INVENTION

Figure 1:
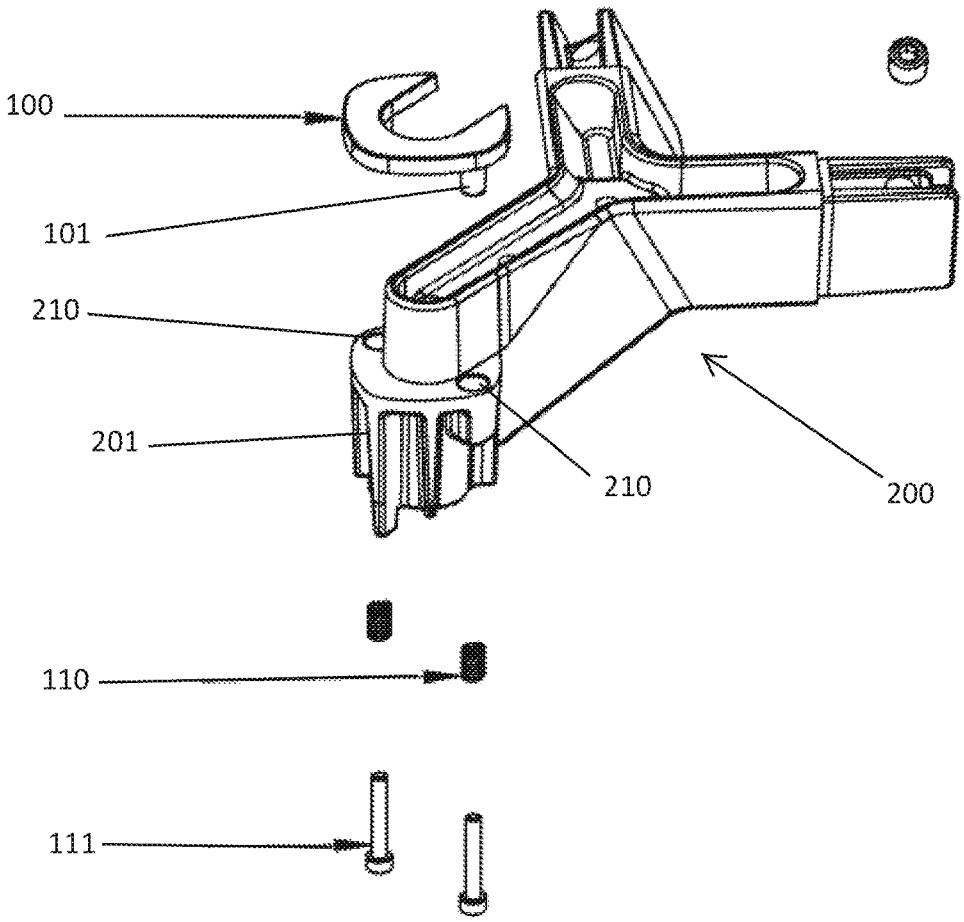
FIG. 1 is an isometric exploded view of a floating table leg cap and supporting member, according to an example of the present invention.

The following detailed description includes references to the accompanying drawings, which forms a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention of this disclosure is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful and is not intended to exclude other embodiments from the scope of the invention.

As used herein, the terms "front," "back," "rear," "upper," "lower," "right," and "left" in this description are merely used to identify the various elements as they are oriented in the FIGS., with "front," "back," and "rear" being relative to the apparatus. These terms are not meant to limit the elements that they describe, as the various elements may be oriented differently in various applications.

As used herein, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

The floating table leg cap of the present disclosure is preferably used in conjunction with a corner supporting member configured for receipt into a table leg for constructing a modular table, although those of skill in the art would understand that table frames with other assembly components and supporting members could also be utilized and are within the scope of the present invention.

Figure 2:
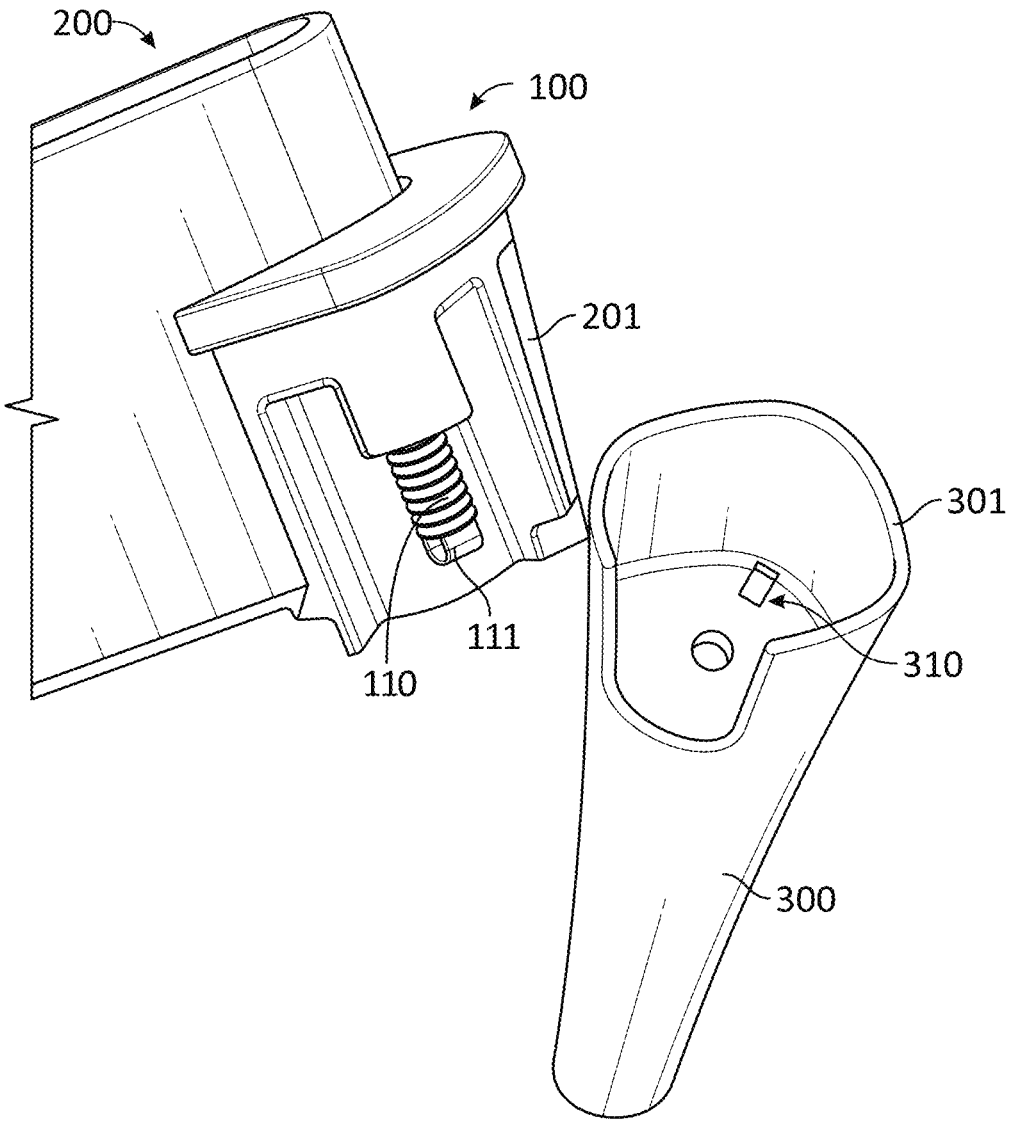
FIG. 2 is an isometric view of the floating table leg cap and supporting member assembled and prior to installation with a table leg, according to an example of the present invention.
Figure 3:
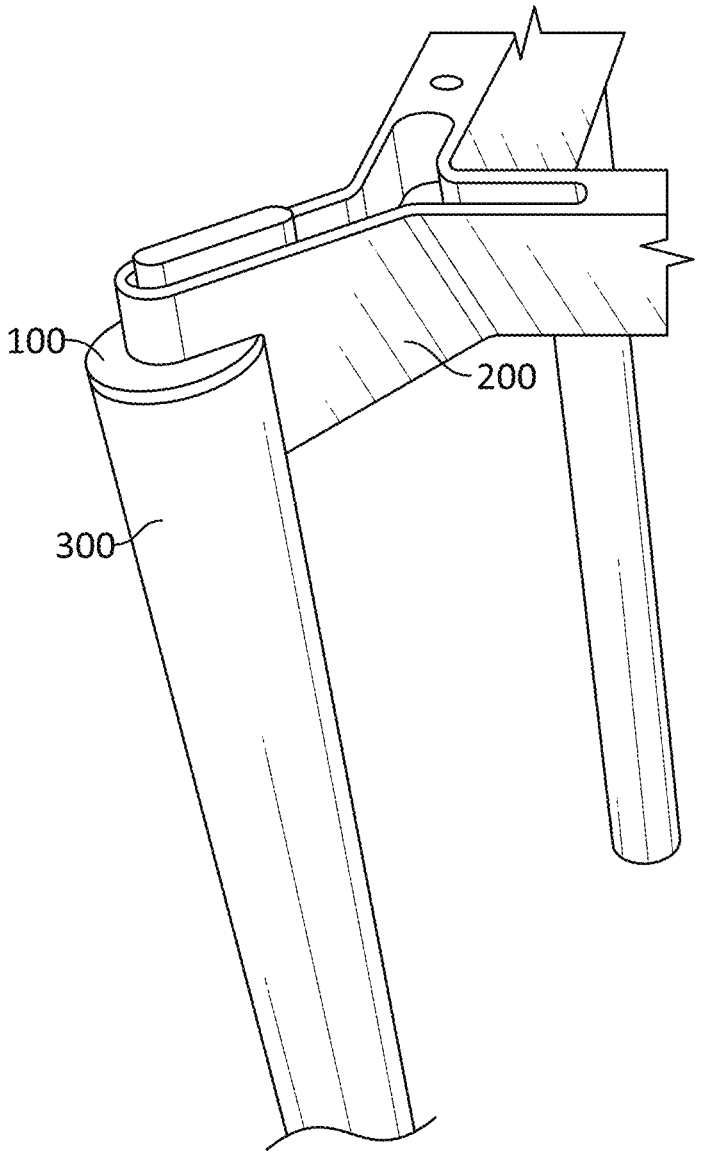
FIG. 3 is an isometric view of the floating table leg cap, supporting member, and table leg in a final assembly, according to an example of the present invention.
Figure 4:
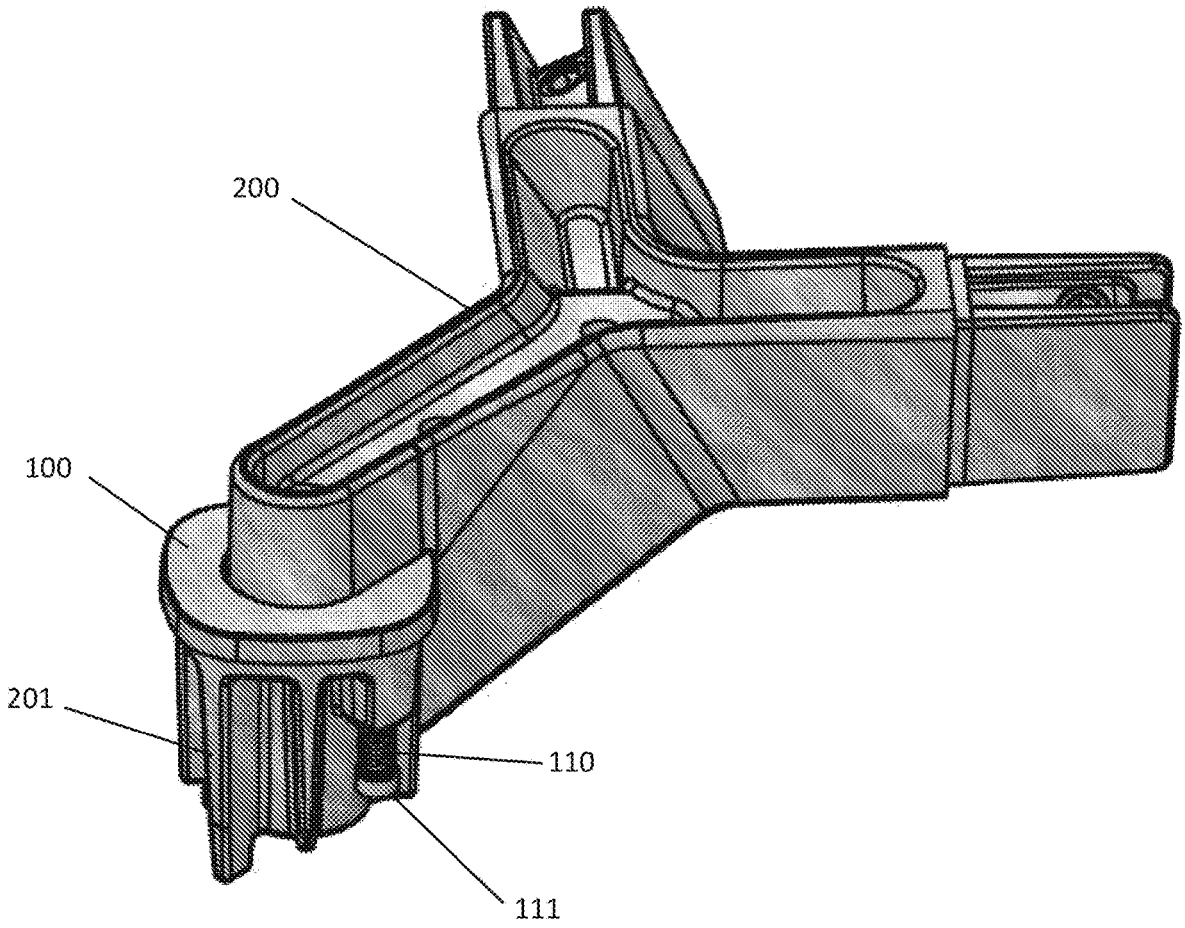
FIG. 4 is an isometric view of the floating table leg cap and supporting member, according to an example of the present invention.

Referring now to FIGS. 1-4 of the floating table leg cap and associated assembly method for a modular table, the floating table leg cap 100 is received on a support member 200. The support member 200 is depicted as a corner piece configured for receipt into a leg member 300 for constructing a modular table assembly for supporting a tabletop. The support member 200 is preferably constructed of a die cast metal and includes a connecting portion 201. The connecting portion 201 having a size and a shape generally corresponding to a size and shape of a cavity 310 within an end 301 of the leg member 300, wherein the connecting portion 201 is press fit into the cavity 310 to complete the modular assembly for a table.

The floating table leg cap 100 generally being a planar member having a size and a shape configured to cover at least a portion of the end 301 of the leg member 300. The floating table leg cap 100 is movably affixed to the connecting portion 201 of the support member 200 though a coupling with at least one resilient member 110 restrained by a fastener 111 received in at least one aperture 210 extending thorough the support member 200 and affixed to the floating table leg cap 100 with the coupling configured to hold the floating table leg cap 100 in adjacency to the end 301 of the leg member 300. The at least one resilient member 110 preferably, but not limited to, a compression spring configured to bias in a direction parallel to a height of the leg member 300 and having a diameter greater than a diameter of the at least one aperture 210.

In the preferred assembly of the present disclosure, the floating table leg cap 100 includes at least one stem 101 extending opposite the planar surface of the floating table leg cap 100. The at least one stem 101 configured for placement into the at least one aperture 210 and for the receipt of the fastener 111. Accordingly, the floating table leg cap 100 is placed onto the connecting portion 201 by placing the at least one stem 101 into the at least one aperture 210 in an alignment and retaining the floating table leg cap 100 through a coupling with the at least one resilient member 110 and the fastener 111.

Preferably, the floating table leg cap 100 includes two stems 101 for receipt into two apertures 210 of the connecting portion 201 retained by a pair of resilient members 110 and fasteners 111. The resilient members 110 generally compress the floating table leg cap 100 against the end 301 of the leg member 300 when in a coupling. This compressive force ensures a tight connection of the leg member 300 and support member 200 and removes any visible gaps resulting from the connection.

The floating table leg cap 100 can be assembled to the supporting member 200 by the manufacturer prior to assembly, wherein the assembly of the table system can be easily accomplished by inserting the supporting member 200 connecting portion 201 into the cavity 310 of the end 301 of the leg member 300 with the floating table leg cap 100 secured against the end 301 of the leg member 300.

Alternately, the floating table leg cap 100 can be assembled by a user prior to a finish assembly of a modular table. Accordingly, the fastener 111 would preferably be a screw that is surrounded by the resilient member 110 and placed into the at least one aperture 210 and secured to the stem 110 of the floating table leg cap 100. After attachment of the floating leg cap 100 to the supporting member 200, the user can then affix the supporting member 200 into the cavity 310 of the leg member 300 for final assembly.

The inventors contemplate several alterations and improvements to the disclosed invention. Other alterations, variations, and combinations are possible that fall within the scope of the present invention. Although various embodiments of the present invention have been described, those skilled in the art will recognize more modifications that may be made that would nonetheless fall within the scope of the present invention. Therefore, the present invention should not be limited to the apparatus described. Instead, the scope of the present invention should be consistent with the invention claimed below.

What is claimed is:

1. A table including table legs and table support members, the table comprising:

the table legs having a first end with a first cavity having a first size and a first shape;

the table support members having a connecting portion, the connecting portion having a size and a shape configured for receipt within the first size and the first shape of the first cavity of the first end in an assembly, the connecting portion having two apertures;

a floating table leg cap, the floating table leg cap having a planar surface;

a pair of fasteners received within the two apertures and coupled to the floating table leg cap; and a pair of resilient members coupled between the floating table leg cap and the pair of fasteners, wherein the pair of resilient members biases the floating table leg cap relative to the table legs first end.

2. The table as in claim 1, wherein the pair of resilient members are a compression spring.

3. The table as in claim 1, wherein the floating table leg cap includes a stem, the stem extending opposite the planar surface and having a size configured for receipt into one aperture of the two apertures.

4. The table as in claim 1, wherein the floating table leg cap includes a pair of stems, the pair of stems extending opposite the planar surface and having a size configured for receipt into the two apertures.

5. A table including table legs and table support members, the table comprising:

the table legs having a first end with a first cavity having a first size and a first shape;

the table support members having a connecting portion, the connecting portion having a size and a shape configured for receipt within the first size and the first shape of the first cavity of the first end in an assembly, the connecting portion having at least one aperture;

a floating table leg cap, the floating table leg cap having a planar surface and at least one stem extending opposite the planar surface with a size for receipt into the at least one aperture;

a fastener received within the at least one aperture and coupled to the floating table leg cap at least one stem; and a resilient member coupled between the floating table leg cap and the fastener, wherein the resilient member biases the floating table leg cap relative to the table legs first end.

6. The table as in claim 5, wherein the connecting portion has two apertures, a pair of fasteners, and a pair of resilient members.

7. The table as in claim 5, wherein the resilient member is a compression spring.

* * * * *